US010132311B2

(12) United States Patent
Nigrin et al.

(10) Patent No.: US 10,132,311 B2
(45) Date of Patent: Nov. 20, 2018

(54) HIGH PRESSURE PUMP

(71) Applicant: Continental Automotive GmbH, Hannover (DE)

(72) Inventors: Uwe Nigrin, Ilmenau (DE); Ngoc-Tam Vu, Ludwigsburg (DE); Andreas Ederer, Walderbach (DE); Uday Bhat, Bangalore (IN); Thejesh Kumar Magadibyredevaru, Bangalore (IN); Marcin Olik, Teublitz (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 28 days.

(21) Appl. No.: 14/758,295

(22) PCT Filed: Aug. 6, 2014

(86) PCT No.: PCT/EP2014/066906
§ 371 (c)(1),
(2) Date: Jun. 29, 2015

(87) PCT Pub. No.: WO2015/055332
PCT Pub. Date: Apr. 23, 2015

(65) Prior Publication Data

US 2016/0208796 A1 Jul. 21, 2016

(30) Foreign Application Priority Data

Oct. 14, 2013 (IN) ..... 3058/DEL/2013

(51) Int. Cl.
*F04B 53/04* (2006.01)
*F02M 55/04* (2006.01)
(Continued)

(52) U.S. Cl.
CPC ..... *F04B 53/04* (2013.01); *F02M 55/04* (2013.01); *F02M 59/025* (2013.01);
(Continued)

(58) Field of Classification Search
CPC ..... F04B 1/0413; F04B 53/04; F04B 53/14; F04B 53/16; F04B 11/00; F04B 39/045
(Continued)

(56) References Cited

U.S. PATENT DOCUMENTS 1,696,825 A * 12/1928 White ..... F02M 37/04 417/364
1,787,700 A * 1/1931 Persons ..... F16J 15/52 417/439
(Continued)

FOREIGN PATENT DOCUMENTS

CN 1481474 A 3/2004 ..... F02M 55/02
CN 101000026 A 7/2007 ..... F02M 59/10
(Continued)

OTHER PUBLICATIONS

J.M. Bergada; A complete analysis of axial piston pump leakage and output flow ripples; Jun. 23, 2010; Applied Mathematical Modelling; p. 1740.*
(Continued)

*Primary Examiner* — Kenneth J Hansen
*Assistant Examiner* — Benjamin Doyle
(74) *Attorney, Agent, or Firm* — Slayden Grubert Beard PLLC

(57) ABSTRACT

A high pressure pump of a common rail pump system includes a pump body having a cylinder with a piston bore and a piston reciprocally driven in the piston bore to pressurize fuel in the cylinder. The piston has an inner end located in the piston bore and an outer end outside the piston bore. A bellow having a first opening and a second opening is arranged between the piston and the pump body, wherein the piston extends through the first and second openings, wherein the bellow is connected to the pump body such that the first opening is sealed on the pump body and wherein the
(Continued)

bellow is connected to the outer end of the piston such that the second opening is sealed on the piston. This arrangement prevents mixing of engine oil and fuel. The bellow may be connected to a drainage line via a one-way valve.

12 Claims, 3 Drawing Sheets

(51) Int. Cl.

| | |
|---|---|
| ***F02M 59/02*** | (2006.01) |
| ***F02M 59/10*** | (2006.01) |
| ***F02M 59/44*** | (2006.01) |
| ***F02M 63/00*** | (2006.01) |
| ***F02M 59/14*** | (2006.01) |
| ***F02M 59/46*** | (2006.01) |
| ***F04B 11/00*** | (2006.01) |
| ***F04B 43/02*** | (2006.01) |
| ***F04B 53/14*** | (2006.01) |
| ***F04B 53/16*** | (2006.01) |

(52) U.S. Cl.
CPC ..... *F02M 59/102* (2013.01); *F02M 59/14* (2013.01); *F02M 59/44* (2013.01); *F02M 59/442* (2013.01); *F02M 59/46* (2013.01); *F02M 63/0054* (2013.01); *F04B 11/00* (2013.01); *F04B 43/02* (2013.01); *F04B 53/14* (2013.01); *F04B 53/16* (2013.01); *F02M 2200/31* (2013.01); *F02M 2200/315* (2013.01); *F02M 2200/9015* (2013.01)

(58) Field of Classification Search
USPC ..... 417/470, 440; 123/446, 447
See application file for complete search history.

(56) References Cited

U.S. PATENT DOCUMENTS

| | | | | | |
|---|---|---|---|---|---|
| 2,530,128 | A * | 11/1950 | Mashinter | F02M 49/02 | 239/88 |
| 2,791,372 | A * | 5/1957 | Abbatiello | F04B 39/0005 | 417/437 |
| 3,887,305 | A * | 6/1975 | Ito | F04B 43/02 | 417/439 |
| 3,994,208 | A * | 11/1976 | Boyer | F04B 53/14 | 92/246 |
| 4,463,663 | A * | 8/1984 | Hanson, Jr. | F15B 15/149 | 92/168 |
| 5,567,134 | A * | 10/1996 | Inoue | F02M 39/02 | 417/490 |
| 5,979,296 | A * | 11/1999 | Kikuchi | F04B 53/143 | 92/71 |
| 6,062,831 | A * | 5/2000 | Konishi | F02M 55/04 | 417/540 |
| 6,131,549 | A * | 10/2000 | Onishi | F02M 55/004 | 123/495 |
| 6,142,060 | A * | 11/2000 | Saito | F04B 1/141 | 417/269 |
| 6,254,364 | B1 * | 7/2001 | Onishi | F04B 11/0016 | 138/26 |
| 6,860,255 | B2 * | 3/2005 | Yamaguchi | C23C 8/80 | 123/495 |
| 6,877,484 | B2 | 4/2005 | Reiter | 123/468 | |
| 7,073,487 | B1 * | 7/2006 | Oono | F02D 41/3845 | 123/456 |
| 7,677,155 | B2 * | 3/2010 | Marriott | F04B 1/0448 | 417/379 |
| 9,587,609 | B2 | 3/2017 | Bachmaier et al. | | |
| 2001/0043874 | A1 * | 11/2001 | Sano | F04B 53/04 | 417/440 |
| 2002/0189589 | A1 * | 12/2002 | Kato | F02M 21/08 | 123/458 |
| 2003/0059322 | A1 * | 3/2003 | Hiraku | F02M 59/368 | 417/505 |
| 2003/0089343 | A1 * | 5/2003 | Yamaguchi | C23C 8/80 | 123/495 |
| 2007/0166174 | A1 * | 7/2007 | Marriott | F04B 1/0448 | 417/310 |
| 2008/0008605 | A1 * | 1/2008 | Bauer | F02M 59/102 | 417/375 |
| 2008/0170953 | A1 * | 7/2008 | Lund | F04B 23/04 | 417/470 |
| 2009/0008883 | A1 * | 1/2009 | Nakayama | F02M 59/102 | 277/596 |
| 2009/0126690 | A1 * | 5/2009 | Garland | F02M 59/02 | 123/456 |
| 2010/0040486 | A1 * | 2/2010 | Kellar | B26F 3/004 | 417/273 |
| 2011/0146600 | A1 * | 6/2011 | Rajagopalan | F02M 53/00 | 123/41.31 |
| 2014/0202431 | A1 * | 7/2014 | Katsura | F02D 1/06 | 123/447 |
| 2014/0216409 | A1 * | 8/2014 | Katsura | F02D 41/3809 | 123/456 |
| 2015/0001917 | A1 * | 1/2015 | Murayama | B60T 11/18 | 303/14 |
| 2015/0308394 | A1 * | 10/2015 | Flo | F02M 59/02 | 417/437 |
| 2016/0084189 | A1 * | 3/2016 | Pursifull | F02D 41/3863 | 123/299 |
| 2016/0208796 | A1 * | 7/2016 | Nigrin | F02M 59/14 | |

FOREIGN PATENT DOCUMENTS

| | | | | |
|---|---|---|---|---|
| CN | 102971522 | A | 3/2013 | F02M 63/00 |
| DE | 102008002088 | A1 | 12/2009 | F02M 59/02 |
| DE | 102008002195 | A1 | 12/2009 | F02M 59/10 |
| DE | 102009001566 | A1 | 9/2010 | F02M 59/02 |
| EP | 0879960 | A2 | 11/1998 | F04B 1/14 |
| EP | 1876353 | A1 | 1/2008 | F02M 59/00 |
| EP | 2620633 | A1 | 7/2013 | F02M 59/10 |
| KR | 1020000026444 | A | 5/2000 | F02M 59/00 |
| KR | 100331760 | B1 | 10/2002 | F02M 59/44 |
| WO | 2013/098301 | A1 | 7/2013 | F04B 1/04 |
| WO | 2015/055332 | A1 | 4/2015 | F02M 55/04 |
| WO | WO 2015055332 | A1 * | 4/2015 | F02M 59/14 |

OTHER PUBLICATIONS

Chinese Office Action, Application No. 201480007057.2, 13 pages, dated Jan. 24, 2017.
International Search Report and Written Opinion, Application No. PCT/EP2014/066906, 11 pages, dated Sep. 8, 2014.
Korean Office Action, Application No. 2017079554868, 14 pages, dated Nov. 15, 2017.
Korean Notice of Allowance, Application No. 2018027173252, 4 pages, dated Apr. 19, 2018.

* cited by examiner

HIGH PRESSURE PUMP

CROSS-REFERENCE TO RELATED APPLICATIONS

This application is a U.S. National Stage Application of International Application No. PCT/EP2014/066906 filed Aug. 6, 2014, which designates the United States of America, and claims priority to IN Application No. 3058/DEL/2013 filed Oct. 14, 2013, the contents of which are hereby incorporated by reference in their entirety.

TECHNICAL FIELD

The invention relates to a high pressure pump for a common rail pump system and to a common rail pump system.

BACKGROUND

Known high pressure pumps for common rail pump systems usually comprise a piston movably supported in a piston bore of a cylinder created in a pump body. The piston is reciprocally driven by an eccentric and alternatingly moves inwards into the piston bore and outwards. In the outwards motion of the piston the piston bore receives fuel from a fuel inlet. In the subsequent inwards motion the piston exerts a certain pressure onto the fuel and provides it to a fuel outlet, which in turn is connected to a rail of a common rail fuel injection system.

The pump body may be attached directly to the engine for easily driving the piston. Usually, the piston is sealed by means of a piston seal and/or a dedicated small clearance relative to the piston bore. Hence, separating fuel and engine oil and the prevention of mixing of engine oil and fuel is an issue when the high pressure pump is mounted on the engine. A reliable separation is desirable for ensuring correct emission norms and avoiding dilution of engine oil due to fuel leakage.

SUMMARY

One embodiment provides a high pressure pump for a common rail pump system, the pump comprising a pump body having a cylinder with a piston bore, and a piston reciprocally driven in the piston bore by an eccentric to pressurize fuel in the cylinder, the piston having an inner end located in the piston bore and an outer end outside the piston bore, wherein a bellow having a first opening and a second opening is arranged between the piston and the pump body, wherein the piston extends through the first opening and the second opening, wherein the bellow is connected to the pump body such that the first opening is sealed on the pump body and wherein the bellow is connected to the outer end of the piston such that the second opening is sealed on the piston.

In a further embodiment, the high pressure pump includes a back leak connection at the bellow, which is connected with a drainage line for draining leakage fuel off an interior space of the bellow.

In a further embodiment, a one-way valve is arranged between the back leak connection and the drainage line.

In a further embodiment, the piston bore comprises a radially outwards extending recess connected with the drainage line.

In a further embodiment, the one-way valve is upstream of a connection of the recess in the piston bore and the drainage line.

In a further embodiment, a fuel inlet is connected to the radially outwards extending recess.

In a further embodiment, a gap between the piston and the piston bore is greater than 0.008 mm.

In a further embodiment, a pressure dampening membrane is supported in the bellow such that a permeable fluid receiving space is created in the bellow, wherein a fuel inlet of the high pressure pump is connected with the fuel receiving space and a fuel inlet of the piston bore is connected with the fluid receiving chamber, wherein the pressure dampening membrane is adapted for attenuating pressure peaks of incoming flow of fuel.

In a further embodiment, the membrane comprises a drainage port or pores or a gap to the bellow for providing a permeability.

Another embodiment comprises a use of a bellow to seal a piston in a piston bore in a pump body of a high pressure pump of a common rail pump system according to any of embodiments disclosed above.

BRIEF DESCRIPTION OF THE DRAWINGS

Example embodiments of the invention are discussed in detail below with reference to the drawings, in which.

DETAILED DESCRIPTION

Figure 1A:
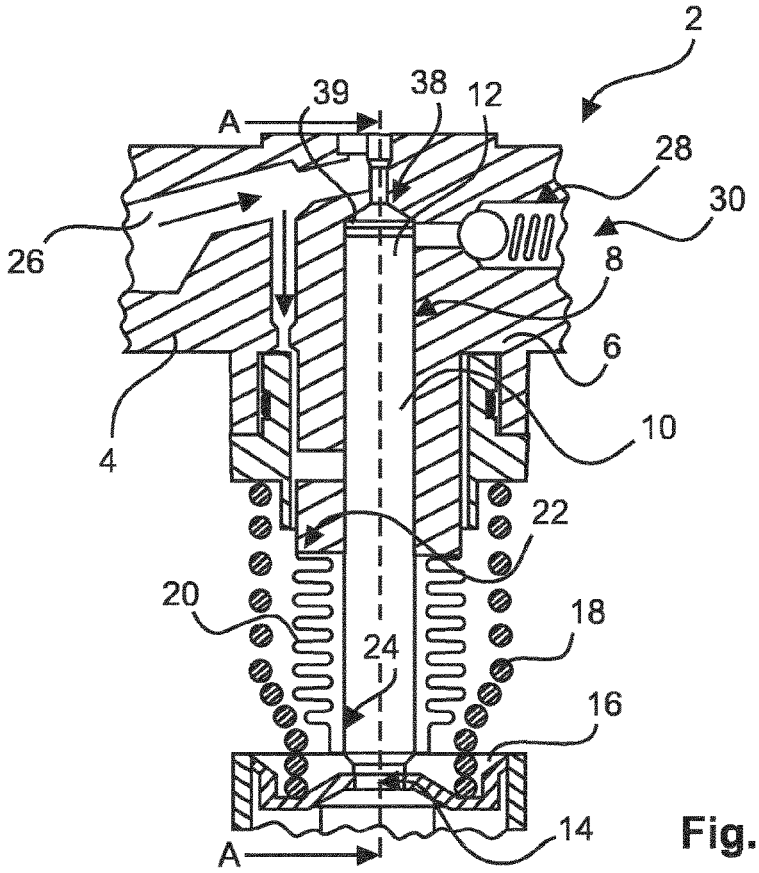
FIGS. 1*a* and 1*b* show a part of a first exemplary embodiment of a high pressure pump in two different viewing directions.

Embodiments of the invention provide a high pressure pump for a common rail pump system, which is able to avoid mixing of engine oil and fuel with a distinct reliability.

Some embodiments provide a high pressure pump for a common rail pump system, wherein the high pressure pump comprises a pump body having a cylinder with a piston bore and a piston reciprocally driven in the piston bore by an eccentric to pressurize a fuel in the cylinder.

The piston has an inner end located in the piston bore and an outer end outside the piston bore.

A bellow having a first opening and a second opening is arranged between the piston and the pump body, wherein the piston extends through the first opening and the second opening, wherein the bellow is connected to the pump body such that the first opening is sealed on the pump body and wherein the bellow is connected to the outer end of the piston such that the second opening is sealed on the piston.

Preferably, the pump body is attachable to or couplable with a combustion engine and more particularly an engine block or a cylinder head of a combustion engine. This allows the outer end of the piston of the high pressure pump to axially move in an opening of the engine in order to be driven directly by an eccentric, which in turn is driven by the engine. The high pressure pump may be of a plug-in pump type. Due to the vicinity of an opening of the engine it is possible that engine oil reaches the high pressure pump.

Providing a bellow at a side of the pump body facing the outer end of the piston and to the respective opening of the engine, prevents an inflow of engine oil into the piston bore and vice versa. The bellow has a fluid-tight jacket, which is elastic enough to follow the reciprocating motion of the piston.

Hence, in case fluid exits the interface between piston and cylinder, any fuel leakage is collected in the bellow and is not able to exit the high pressure pump through a clearance necessary for the piston motion. Also, engine oil cannot pass through the bellow into the pump body, such that introduction of engine oil into the fuel and consequently its dilution can be prevented.

Preferably, the bellow is a metal bellow, which comprises a plurality of ring-shaped folded or curved rim-like segments welded together or integrally formed through rolling, hydroforming or deep-drawing. The bellow may additionally be coated with a fuel and oil resistant plastic coating. The design of the bellow shall conform the expected motion of the piston, which directly determines the motion of the bellow, and shall conform the desired life time of the high pressure pump. The bellow may also be made of other non-metal materials like PTFE, rubber or a silicone material The attachment of the bellow to the pump body and the piston, respectively, may be accomplished through different attachment methods, such as through welding or gluing.

Especially, the bellow may comprise a flange that mates with an attachment flange on the pump body. The bellow may consequently be screwed to the pump body through a set of circumferentially distributed screws. For improving the sealing function, a further seal may be introduced into the interface between bellow and attachment flange.

In one embodiment, the bellow comprises a back leak connection, which is coupled to a drainage line for draining leakage fuel off an interior space of the bellow. The back leak connection is to be understood as a fluid port for delivering fluid from the interior space of the bellow to the outside. In case a fuel leakage occurs through a clearance between the piston and the piston bore, the leaked fuel accumulates in the bellow and may be fed back to a fuel circuit by means of the back leak connection and the drainage line. By permanently draining any fuel leakage from the interior space of the bellows the reliable sealing function is maintained and an over-filling or any maintenance related thereto can be prevented.

It is preferred that a one-way valve is arranged between the back leak connection and the drainage line. The one-way or check valve allows leakage fuel from the bellow to flow to the drainage line. At the same time it prevents fuel from a fuel circuit to reach the interior space of the bellow directly and pressure induced damages of the bellow can be prevented.

In another embodiment, a piston bore in the cylinder comprises a radially, outwards extending recess connected with the drainage line. The recess may be realized as a pocket in the circumferential delimiting surface of the piston bore. A connection to the drainage line may be accomplished through a bore hole in the recess or a respective extension from the recess to the drainage line directly in the pump body. During the motion of the piston into the piston bore, i.e. in an inward stroke of the piston into the piston bore, the distance between the pump body and the outer end of the piston is reduced up to a minimum. Consequently, the bellow is compressed and pumps leaked fuel to the drainage line. Through the fuel flow over the drainage line, a suction force is applied onto the recess according to the Bernoulli effect, which helps to suck fuel over the recess from the piston bore directly into the drainage line.

In another embodiment, a fuel inlet is connected to the radially outwards extending recess. This allows a mixing of the incoming "fresh" fuel with fuel accumulating in the recess, such that it is automatically cooled.

It may be further advantageous that the one-way valve between the back leak connection and the drainage line is upstream of the connection of the recess in the piston bore and the drainage line. This may prevent the back leak from the piston bore into the bellow over the recess in case the pressure inside the interior space of the bellow is too low for opening the one-way valve. Further, the installation of the one-way valve is easier to accomplish as it may simply be inserted from a side of the pump body facing the outer end of the piston, while the recess in the piston bore is further inside the pump body.

Due to the highly reliable sealing function provided by the bellow, the seal between the piston and the piston bore in which it is moving does not need to meet as stringent requirements as in usual high pressure pumps. Hence, the clearance between piston and piston bore, which often lies in a range of 0.003 mm to 0.008 mm can be exceeded. Preferably, the clearance between the piston and the piston bore is greater than 0.008 mm. With an increased clearance the manufacturing cost may be reduced due to less precision manufacturing techniques.

In another embodiment, a pressure dampening membrane is arranged in the bellow such that a fluid receiving space is created in the bellow between the outer end of the piston and the pump body. A fuel supply of the high pressure pump is connected with the fluid receiving space and a fuel inlet of the piston bore is connected with the fluid receiving space. Hence, the fluid receiving space is largely separated from the remaining interior space of the bellow through the dampening membrane. The pressure dampening membrane is generally a flexible, plate-like body, which may exemplarily be realized by two metal plates joined together and enclosing a small air volume inside. Pressure peaks in the pump may be initiated by quick closing or opening movements of the inlet valve. These peaks may be carried to the inlet line as well if they are not damped. If such a pressure peak during the pump operation occurs, the enclosed air volume is compressed, such that the dampening membrane acts like a spring. The pressure peak is compensated to a large extent.

The dampening membrane may be made from any flexible material of a defined shape, e.g. a plate shape, preferably with different layers (rubber or plastic etc) with or without pores, that has capability to damp the pressure peaks. The damping membrane may be fixed in the below or in the pump body by a clip, screw, or simply a groove in the bellow or pump.

The receiving space is not fluid tight to the other zone of the bellow. The fuel is able to move between the two zones separated by the dampening membrane either through a special port or pores within the dampening membrane, which is only provided for dampening the pulsations in the fuel and not to seal the two separated zones. However, due to the compressing action and the flow resistance of the openings in the dampening membrane, the pressure peaks are clearly attenuated.

The dampening membrane may be manufactured from a thermoplastic material, such as PTFE, or a rubber-like material such as Silicone, Butyl, EPDM, Nitrile or FPM. It allows an elastic deformation, which prevents the direct transfer of distinct pressure peaks between the fuel supply and the fuel inlet of the piston bore.

Still further, the membrane may advantageously comprise a drainage port for delivering accumulated fuel from the interior space of the bellow to a drainage line. The advantages of dampening a pump operation as well as the clearly improved sealing function are consequently combined.

Other embodiments provide a common rail pump system comprising an internal transfer pump and a high pressure pump according to the above. The common rail pump system is mainly used for injection systems in Diesel engines. The internal transfer pump may be attached to the high pressure pump and feeds fuel from a fuel tank to the fuel inlet of the high pressure pump. The type of this internal transfer pump is not relevant for the invention.

Still other embodiments provide for the use of a bellow to seal a piston in a piston bore in a pump body of a high pressure pump of a common rail pump system according to any embodiment of the pump disclosed herein.

Figure 1B:
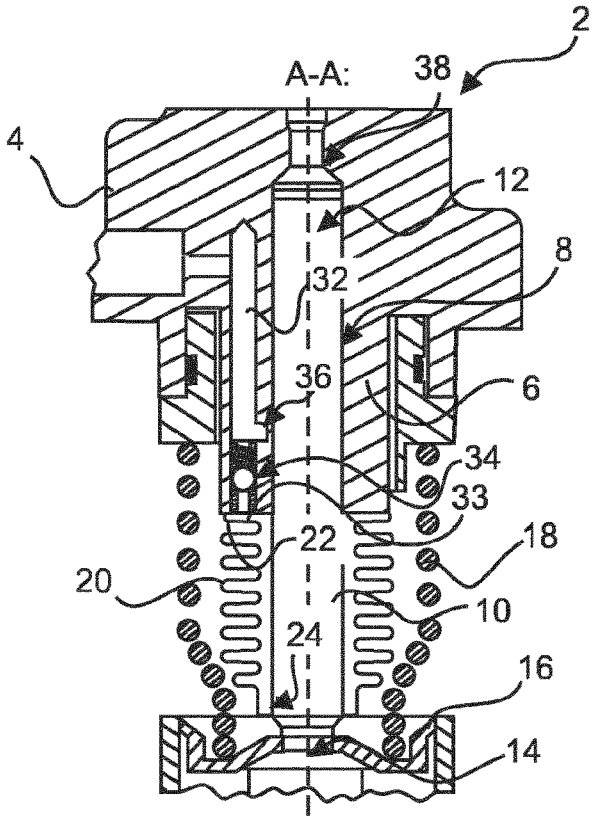

A first exemplary embodiment of a high pressure pump 2 is shown in FIGS. 1*a* and 1*b*. While FIG. 1*a* indicates a sectional plane A-A, the respective sectional view is depicted in FIG. 1*b*.

The high pressure pump 2 comprises a pump body 4 having a cylinder 6 with a piston bore 8, in which a piston 10 is reciprocally moving. The pump body preferably is a molded component and the piston bore with a precise clearance and roughness is reworked into the component.

Piston 10 comprises an inner end 12 and an outer end 14, onto which outer end 14 an eccentric (not shown) acts upon. For this purpose, a tappet, flange or force plate 16 is attached to the outer end 14 of the piston 10, which also receives an end of a compression spring 18, which is also supported on the pump body 4. Spring 18 is used for returning piston 10 from a position inside the piston bore 8 into an outwards position. Due to the eccentric drive, the piston 10 provides a continuously reciprocating motion for pressurizing and pumping fuel.

The high pressure pump 2 furthermore comprises a bellow 20, which has a first opening 22 and a second opening 24. The first opening 22 is in a sealing contact with a part of the pump body 4, while the second opening 24 is in a sealed contact with the outer end 14 of the piston 10. The bellow 20 thereby provides a sealing function between the interior of pump body 4 and the piston 10 for preventing leakage of fuel from inside the high pressure pump 2 to its exterior and inflow of engine oil in case high pressure pump 2 is mounted on an engine.

The attachment of bellow 20 to the pump body 4 or to the piston 10 may be accomplished by welding, press-fitting, gluing or any other attachment method, which may depend on the material composition between pump body 4, piston 10 and bellow 20.

Depending on the motion of the piston 10 the bellow 20 is continuously compressed and expanded. Exemplarily, the bellow 20 is made from a metal material for withstanding the continuously reciprocating motion of the piston 10.

Fuel, which is to be pressurized by the high pressure pump 2, enters fuel inlet 26, e.g. by an internal transfer pump connected to the fuel inlet 26, and reaches the piston bore 8. While the piston 10 moves in an inwards direction, i.e. upwardly in the drawing plane, the fuel is pressed through a check valve (non-return valve or one-way valve) 28, which in turn is connectable to the rail of a common rail system. When the piston 10 moves in the opposite direction, i.e. outwards or downwardly in the drawing plane, fuel is sucked from the fuel inlet 26 into the piston bore 8. Consequently, during a reciprocating motion, fuel is constantly pressurized and delivered to the outlet 30.

During the pumping process and due to the high fuel pressure, fuel may leak through the gap between the piston bore 8 and the piston 10 into the interior space of the bellow 20. Here, it is accumulated and prevented from entering an engine opening. For enabling the feedback of accumulated leakage fuel into a fuel circuit, the interior space of the bellow 20 is connected with a drainage line 32 by means of a one-way valve 34 downstream of a back-leak connection 33. The use of a one-way valve is advantageous to prevent the direct inflow of fuel from the inlet 26 over the drainage line 32 into the interior space of the bellow 20.

As explained above, during the reciprocating motion of piston 10 in piston bore 8, the bellow 20 is continuously compressed and un-compressed. Due to the sealing between the pump body 4 and the piston 10, the interior space of the bellow 20 decreases and increases repeatedly. As a result, accumulated fuel leakage is pumped through one-way valve 34 into the drainage line 32, which is also coupled with the fuel inlet 26.

The piston bore 8 comprises an outwardly extending recess 36, which is coupled with the drainage line 32 downstream of one-way valve 34. By pumping leakage fuel from the interior space of the bellow 20 into drainage line 32, it passes the recess 36. According to Bernoulli's principle, which states that for an inviscid flow, an increase in the speed of the fluid occurs simultaneously with a decrease in pressure or a decrease in the fluid's potential energy, a suction pressure is acting upon recess 36. Consequently, fuel that tends to leak from the clearance between the piston 10 and the piston bore 8 is sucked into the drainage line 32 directly through the recess 36, before it may enter the bellow 20.

The inlet 26 is also connected to recess 36 in the piston bore 8. Here, the fresh fuel is mixed with hot fuel that is leaked from the piston clearance. This mixture is sucked to the drainage bore 32 by Bernoulli's principle. The advantage of this is that the pump has an integrated cooling function, which prevents the pump body from overheating as the hot fuel remains in the bore 8 for longer time.

Further, an inlet valve 38 is arranged at a top of the piston bore 8, which is controllable for adjusting the through-flow of fuel from the fuel inlet 26 into a fuel inlet 39 of the piston bore 8.

Figure 2:
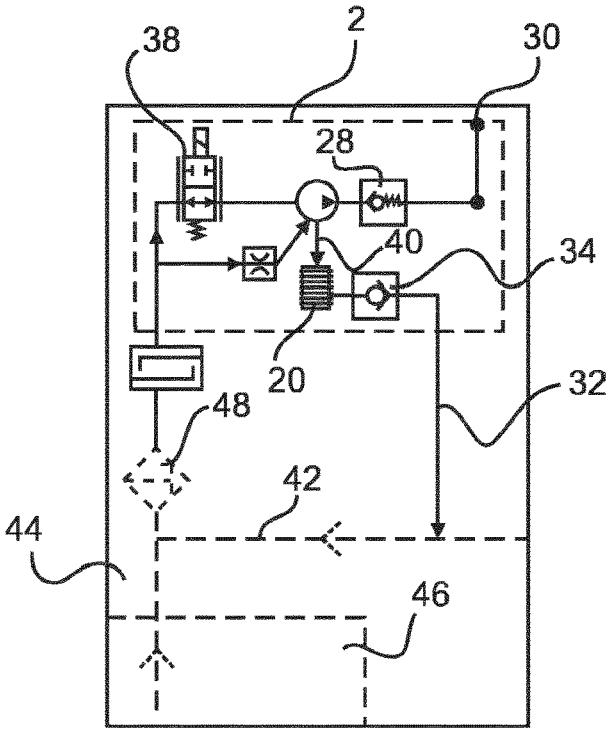
FIG. 2 shows a circuit diagram of a common rail pump system with a high pressure pump according to FIGS. 1*a* and 1*b*.

FIG. 2 shows a hydraulic circuit diagram of a common rail pump system having a high pressure pump 2 according to FIGS. 1*a* and 1*b*. The high pressure pump 2 is indicated by a dashed rectangle. The pump mechanism including the cylinder 6, in which the bore 8 is located that encloses the piston 10, which is movable in an axial direction, is shown by a common pump symbol. The check valve 28 is located downstream of the pump and provides pressurized fuel at the outlet 30. Through the inlet valve 38, the pump is provided with fuel.

As a special feature of the high pressure pump 2 according to the invention, the bellow 20 receives leakage fuel 40 indicated by a dashed arrow and provides it through the one-way valve 34 to the drainage line 32, which is fed back to the fuel inlet 26 through a feedback line 42, which is discharged into a fuel supply line 44 from a tank 46. The fuel supply line 44 further comprises a filter 48. Any fuel leakage is reused and mixing with engine oil or dilution of fuel by engine oil is prevented.

Figure 3:
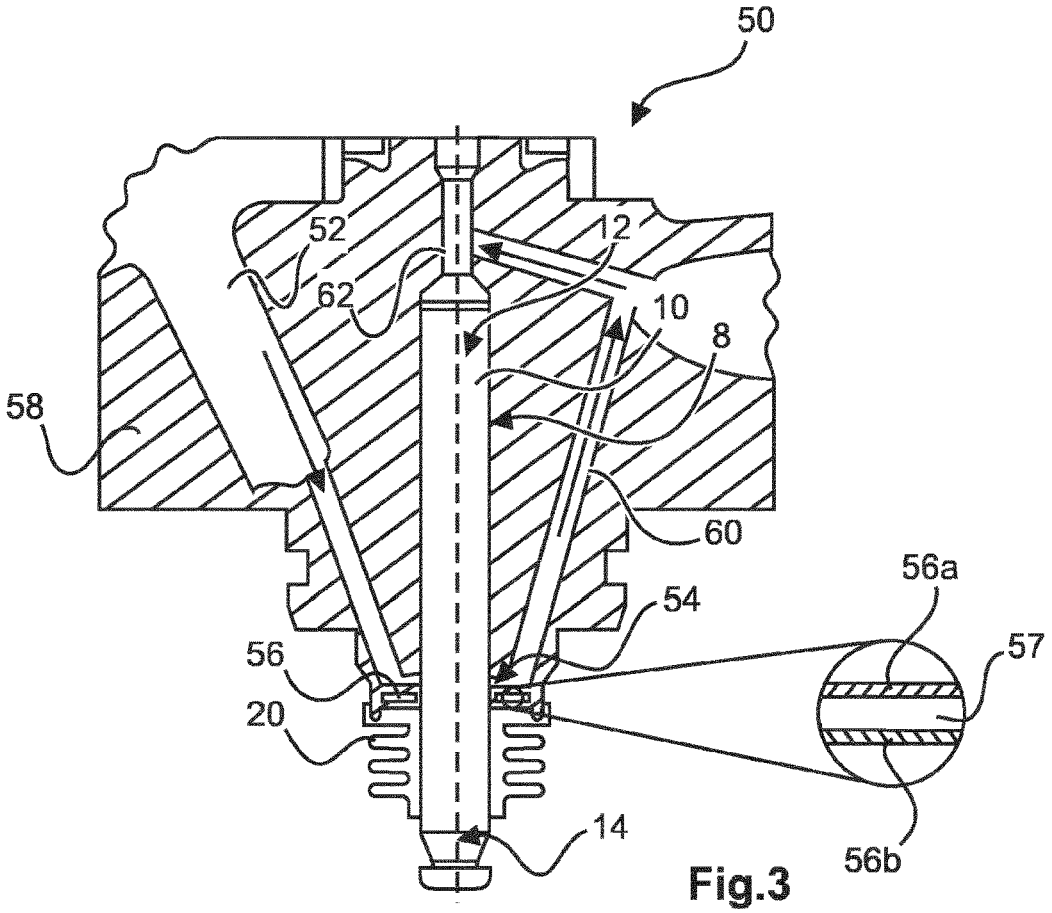
FIG. 3 shows a second exemplary embodiment of a high pressure pump in a sectional detail.

In FIG. 3, a slightly modified high pressure pump 50 is shown in a sectional detail view. The pump body 4 as shown in the previous FIGS. 1*a* and 1*b* is modified to a pump body 58 in that a fuel inlet 52 for feeding fuel into the high pressure pump 50 is directly connected with a receiving space 54 inside the bellow 20 above a dampening membrane 56 supported therein, e.g. through clips, screws or grooves in the bellow 20.

The dampening membrane 56 is shown as a flexible plate comprising two joined plates 56*a* and 56*b* made from a metal or plastic material, wherein the two plates encapsulate an air volume 57 between them. On fuel pressure peaks in this region, the plates compress the encapsulated air and act like a spring, which leads to a dampening process.

The dampening membrane 56 may also comprise pores which have an additional capability to damp the pressure peaks.

The dampening membrane 56, is installed in bellow 20 at a side facing away from the outer end 14 of the piston 10 and facing to the pump body 58. The receiving space 56 is connected to a feed line 60, which in turn is connected with an inlet port 62 of the piston bore 8. The resulting detour of the fuel allows to compensate pressure peaks through the dampening process of the dampening membrane 56.

Figure 4:
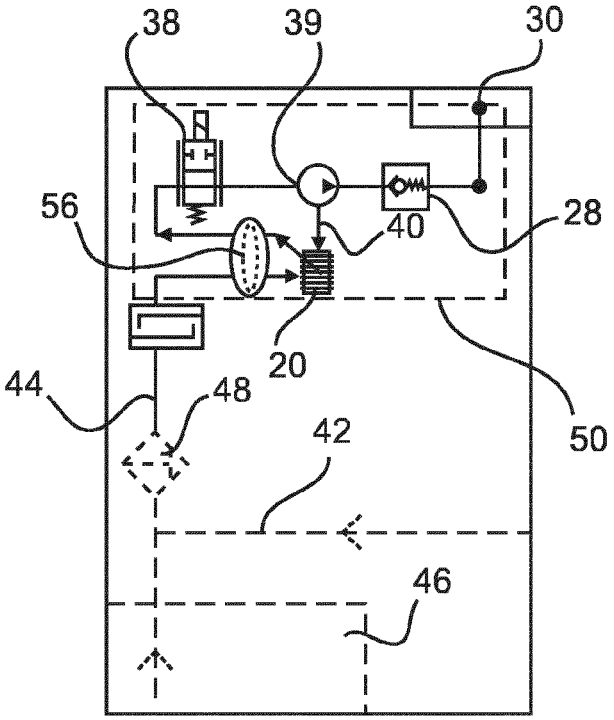
FIG. 4 shows a circuit diagram of a common rail pump system with a high pressure pump according to FIG. 3.

This is further clarified in FIG. 4, which shows a circuit diagram of a common rail pump system having a high pressure pump 50 of FIG. 3. Here, the membrane 56 acts as a dampening means for reducing pressure peaks of the incoming fuel.

In addition, it should be pointed out that "comprising" does not exclude other elements or steps, and "a" or "an" does not exclude a plural number. Furthermore, it should be pointed out that characteristics or steps which have been described with reference to one of the above exemplary embodiments can also be used in combination with other characteristics or steps of other exemplary embodiments described above. Reference characters in the claims are not to be interpreted as limitations.

LIST OF REFERENCE SIGNS

2 high pressure pump
4 pump body
6 cylinder
8 piston bore
10 piston
12 inner end of piston
14 outer end of piston
16 force plate
18 spring
20 bellow
22 first opening
24 second opening
26 fuel inlet
28 check valve
30 fuel outlet
32 drainage line
33 back-leak connection
34 one-way valve
36 recess
38 inlet valve
39 fuel inlet
40 leakage fuel
42 feedback line
44 fuel supply line
46 tank
48 filter
50 high pressure pump
52 fuel inlet
54 receiving space
56 dampening membrane
56*a* membrane plate
56*b* membrane plate
57 air volume
58 pump body
60 feed line
62 inlet port

What is claimed is:

1. A high pressure pump of a common rail pump system, the high pressure pump comprising:

a pump body having a cylinder with a piston bore, a piston reciprocally driven in the piston bore to pressurize fuel in the cylinder, the piston having an inner end located in the piston bore and an outer end outside the piston bore, a bellow arranged outside the pump body, extending between the piston and the pump body and having a first opening concentric to the piston bore and connected to the pump body and a second opening remote from the pump body, a back leak connection at the bellow, connected to a drainage line for draining leakage fuel off an interior space of the bellow and delivering it to a fuel supply line coming from a fuel tank, and a recess extending from the drainage line hydraulically connected to the piston bore so that fuel flowing through the drainage line applies a suction to such that fuel leaking in a clearance between the piston and the piston bore is sucked into the drainage line directly through the recess before it enters the bellow, wherein the piston extends through the first opening of the bellow into the piston bore, wherein the bellow is connected to the pump body such that the first opening is sealed on the pump body and wherein the bellow is connected adjacent to the outer end of the piston such that the second opening is sealed on the piston.

2. The high pressure pump of claim 1, comprising a one-way valve arranged between the back leak connection and the drainage line.

3. The high pressure pump of claim 2, wherein the one-way valve is upstream of the recess.

4. The high pressure pump of claim 1, comprising a fuel inlet connected to the recess.

5. The high pressure pump of claim 1, comprising a pressure dampening membrane supported in the bellow such that a permeable fuel receiving space is created in the bellow, wherein a fuel inlet of the high pressure pump is connected with the permeable fuel receiving space and a fuel inlet of the piston bore is connected with the permeable fuel receiving space, wherein the pressure dampening membrane is configured to attenuate pressure peaks of incoming flow of fuel.

6. The high pressure pump of claim 5, wherein the membrane comprises a drainage port or pores or a gap to the bellow that provides a permeability.

7. A high pressure pump of a common rail pump system, the high pressure pump comprising:

a pump body having a cylinder with a piston bore, a piston reciprocally driven in the piston bore to pressurize fuel in the cylinder, a leakage gap between an outer surface of the piston and an inner surface of the piston bore, a bellow having a first end secured to the pump body concentric with the piston bore and a second end secured to the piston remote from the pump body, and defining a bellow internal volume within the bellow, a back leak connection at the bellow, connected to a drainage line for draining leakage fuel off an interior space of the bellow and delivering it to a fuel supply line coming from a fuel tank, and a recess extending from the drainage line hydraulically connected to the piston bore so that fuel flowing through the drainage line applies a suction to such that fuel leaking in a clearance between the piston and the piston bore is sucked into the drainage line directly through the recess before it enters the bellow, wherein the bellow internal volume is communicatively coupled to both (a) the leakage gap between the outer surface of the piston and the inner surface of the piston bore and (b) the drainage line, wherein the bellow is coupled to the piston at the second end such that a reciprocal movement of the piston causes a corresponding reciprocal change in the bellow internal volume, and wherein during the reciprocal movement of the piston, fuel leaks through the leakage gap and into the bellow internal volume, and said fuel subsequently pumped from the bellow internal volume into the drainage line due to the reciprocal change in the bellow internal volume.

8. The high pressure pump of claim 7, comprising a one-way valve arranged in the drainage line or at a connection between the drainage line and the bellow internal volume.

9. The high pressure pump of claim 7, comprising a fuel inlet connected to the recess.

10. The high pressure pump of claim 7, comprising a one-way valve arranged in the drainage line or at a connection between the drainage line and the bellow internal volume, wherein the one-way valve is upstream of a connection of the recess.

11. The high pressure pump of claim 7, comprising a pressure dampening membrane supported in the bellow such that a permeable fuel receiving space is created in the bellow, wherein a fuel inlet of the high pressure pump is connected with the permeable fuel receiving space and a fuel inlet of the piston bore is connected with the permeable fuel receiving space, wherein the pressure dampening membrane is configured to attenuate pressure peaks of incoming flow of fuel.

12. The high pressure pump of claim 11, wherein the membrane comprises a drainage port or pores or a gap to the bellow that provides a permeability.

* * * * *